US006511258B1

(12) United States Patent
Johnsen

(10) Patent No.: US 6,511,258 B1
(45) Date of Patent: Jan. 28, 2003

(54) METHOD FOR CONTROLLING THE AMOUNT OF IONIZED GASES AND/OR PARTICLES OVER ROADS, STREETS, OPEN SPACES OR THE LIKE

(75) Inventor: Torfinn Johnsen, Sandnes (NO)

(73) Assignee: Applied Plasma Physics AS (NO)

( * ) Notice: Subject to any disclaimer, the term of this patent is extended or adjusted under 35 U.S.C. 154(b) by 0 days.

(21) Appl. No.: 09/508,981

(22) PCT Filed: Sep. 17, 1998

(86) PCT No.: PCT/NO98/00278

§ 371 (c)(1),
(2), (4) Date: May 15, 2000

(87) PCT Pub. No.: WO99/14435

PCT Pub. Date: Mar. 25, 1999

(30) Foreign Application Priority Data

Sep. 18, 1997 (NO) ..... 974300

(51) Int. Cl.[7] ..... E01C 1/00

(52) U.S. Cl. ..... 404/75; 404/44; 404/71; 404/76; 404/28; 60/274

(58) Field of Search ..... 404/44, 71, 75, 404/76, 28; 60/274

(56) References Cited

U.S. PATENT DOCUMENTS

| | | | | | |
|---|---|---|---|---|---|
| 3,166,518 | A | * | 1/1965 | Barnard | 252/503 |
| 3,509,696 | A | * | 5/1970 | Thompson | 96/66 |
| 3,573,427 | A | | 4/1971 | Minsk | |
| 3,729,898 | A | * | 5/1973 | Richardson | 261/116 |
| 4,174,912 | A | * | 11/1979 | Peterson | 404/27 |
| 4,319,854 | A | | 3/1982 | Marzocchi | |
| 4,330,567 | A | * | 5/1982 | Gillette | 427/460 |
| 4,944,778 | A | * | 7/1990 | Yanagawa | 96/66 |
| 4,994,629 | A | * | 2/1991 | Tatum, Jr. et al. | 174/6 |
| 5,080,773 | A | * | 1/1992 | Tatum, Jr. et al. | 204/196.34 |
| 5,243,950 | A | * | 9/1993 | Dalupan | 123/536 |
| 5,447,564 | A | * | 9/1995 | Xie et al. | 106/644 |
| 5,695,619 | A | * | 12/1997 | Williamson et al. | 204/165 |
| 5,707,171 | A | | 1/1998 | Zaleski et al. | |
| 5,787,704 | A | * | 8/1998 | Cravero | 55/DIG. 30 |
| 5,843,383 | A | * | 12/1998 | Williamson et al. | 422/186.04 |

FOREIGN PATENT DOCUMENTS

| | | | | |
|---|---|---|---|---|
| WO | WO 91/14827 | | 10/1991 | |
| WO | 0 627 253 A1 | | 12/1994 | |
| WO | WO 95/04875 | * | 2/1995 | F01N/3/02 |

OTHER PUBLICATIONS

Refractories;Ceramics—p. 11, Week 9307, SU–L.

* cited by examiner

*Primary Examiner*—Heather Shackelford
*Assistant Examiner*—Katherine Mitchell
(74) *Attorney, Agent, or Firm*—Brooks & Kushman P.C

(57) ABSTRACT

There is described a method for controlling the amount of ionized gases and/or particles suspended in the air above roads, streets, open spaces or the like. This is done by establishing an electrical field between the top layer of a road, street, open space or the like, and the said ionized gases and/or particles. By means of controlling the electrical field we will be able to control the amount of ionized gases and/or particles. The invention also indicates how the electrical field can be established between surfaces in the immediate vicinity of a road, street, open space or the like, for example in tunnel walls. The electrical field is established by making at least the top layer of the surface concerned electrically conductive and connecting it to earth or to one pole of an electrical voltage source.

17 Claims, 3 Drawing Sheets

METHOD FOR CONTROLLING THE AMOUNT OF IONIZED GASES AND/OR PARTICLES OVER ROADS, STREETS, OPEN SPACES OR THE LIKE

The present invention concerns a method for controlling the amount of ionised gases and/or particles suspended in the air above roads, streets, open spaces or the like.

THE STATE OF THE ART

The term surface refers to surfaces used for roads, streets, open spaces, including airports, as well as surfaces in the vicinity of roads, streets, open spaces and marking on roads, streets and open spaces. Surfaces of roads, streets and open spaces usually consist of a binding agent mixed with an additive material such as sand, gravel and stones with a certain grain size. The binding agent usually completely surrounds the additive material. The binding material is usually bitumen, which may also be mixed with asphalt, gas tar, bituminous polymers and plastic materials. In the present description the word bitumen is employed, even though the bitumen may be mixed with one or more of the above-mentioned materials. Surfaces in the vicinity of roads, streets and open spaces together with marking on roads, streets and open spaces consist of known per se commercial products.

Bitumen is a very good electrical insulator and is used among other things for encapsulating electrical components. A road surface with a binding agent of bitumen will be an electrical insulator and thus it will not conduct electrical current. It is known that insulating materials such as ebonite, glass and the like can be electrically charged, for example by rubbing against other materials. In the same way the insulating surface on roads, streets and open spaces will be electrically charged by friction due to moving traffic, it will be charged by solar radiation and heating of air molecules which are ionised and which will flow from the surface, and it will be charged by thermal expansion and contraction of the surface. The binding agent in the surface will lose electrons, thus giving the surface a positive charge. In consequence the surface will receive a positive charge relative to the ground which is negatively charged.

It is previously known, e.g. from U.S. Pat. No. 5,707,171 to make a road surface electrically conductive. This, however, has previously only been employed for heating the road surface by passing electric current through it in order to prevent ice formation.

Exhaust gas flows from an internal combustion engine and the gas is normally ionised and has a positive charge. Particles in exhaust gas are similarly positively charged. Dust particles in the air above a roadway are also normally positively charged. The dust particles may come from, amongst other things, the top layer of the roadway, industrial and/or private emission.

An electrically charged surface will act as a pole in an electrostatic system. The surface charge in a road surface which is positive will have the same polarity as the charge of gas ions and/or particles in exhaust gas above roads, streets, open spaces, etc. The surface will therefore repel the said gases and/or particles. The result is that the ionised gases and/or particles above the surface will remain in suspension over roads, streets and open spaces. An electrical Coloumb force has been created which acts on the ionised gases and/or particles. The direction of the force is away from the top layer, thus counteracting gravity. An electrical suspension force has been created.

Ionised gases and/or particles above roads, streets and open spaces, etc. have been shown to represent an ever-increasing health risk. The object of the invention is to control the ionised gases and/or particles. This is achieved by means of an electrical field which is established between the surface as mentioned above and the ionised gases and/or particles which are to be controlled, as indicated in claim 1. The other claims indicate further advantageous features and embodiments of the invention.

According to the invention at least the top layer of the surface and the ionised gases and/or particles will form two electrodes in a capacitor.

DESCRIPTION OF THE INVENTION

The surprising discovery has been made that by using a surface for roads, streets, open spaces, etc. wherein at least the top layer is electrically charged and in electrical contact with earth or a negative voltage source, positively charged gases and positively charged dust particles will be attracted to the surface. This means that harmful and polluting materials will be bound to the surface. The positively charged gases and/or particles will moreover be neutralised by contact with the electrically charged surface. In addition an earthed surface will not be charged by friction due to moving traffic or by solar radiation and heating and ionising of air molecules flowing from the surface or by expansion and contraction of the surface. In addition reduced electrical friction between a vehicle and the surface will be capable of reducing the vehicle's fuel consumption and thereby the discharge of exhaust gases.

By means of the invention the result has been achieved that, instead of being suspended above a surface, exhaust gases and particles from internal combustion engines together with dust particles are attracted to the surface with the result that the air over the surface remains clean. This is of great importance for the task of reducing pollution which is due among other things to exhaust gases from internal combustion engines and the invention therefore is of vital importance for the environment. Large areas of the earth's surface are at present covered by an insulating surface such as bitumen. The extent of this surface is so great that in addition to being important for the environment it may be of importance for the climate and life on earth.

Due to combustion in industry and private households and car traffic, large amounts of ionised gases and/or particles will be formed over roads, streets, open spaces, etc. In such places an electrically charged surface will establish an electrical field, thereby controlling the amount of noxious ionised gases and/or particles. The surface is charged by adding to the currently used binding agent, at least in a top layer of the surface, a conductive material such as, e.g. carbon powder. The surface is then placed in contact with earth or a negative voltage source. This makes the surface a cathode in a capacitor where the positively charged ionised gases and/or particles represent the anode. The electrical field which is created between the anode and the cathode will draw the ionised gases and/or particles towards the top layer, thereby ionising them as well as preventing them from being suspended.

In order to make the surface electrically charged, a network of conductive metal or a piezoelectric material may also be employed under the top layer which is placed in contact with earth or a negative voltage source. The electrically charged top layer may also be composed or a coating which is laid on top of the entire or parts of the surface, for example in the form of road marking or the like.

An electrically charged surface which is in electrical contact with earth will be electrically neutral. It will be capable of emitting or absorbing electrons and by means of friction caused by car wheels a vehicle will remain electrically neutral. The result of this is that neither the vehicle nor the people in the vehicle will be charged, and obtain an electrical voltage relative to the environment. This will prevent unpleasant electric shocks when entering and leaving a vehicle due to potential differences which are common when a vehicle travels on standard insulating surfaces. In the same way an electrically conductive surface will reduce the risk of sparking due to potential differences between a vehicle and the surface. Accidents which can occur due to ignition of inflammable and explosive chemicals and gases which are transported on roads with an electrically conductive surface will thereby be reduced.

Research has shown that car sickness and a feeling of tiredness while driving are due to the build-up of static electrical fields in the vehicle. This will be reduced by the use of an electrically charged surface which is in electrical contact with earth and is thereby electrically neutral. The invention will therefore also be important for traffic safety.

DESCRIPTION OF FIGURES

The invention will now be illustrated in more detail with reference to the drawings which illustrate embodiments of the invention and which are not limiting for the concept of the invention.

Figure 1:
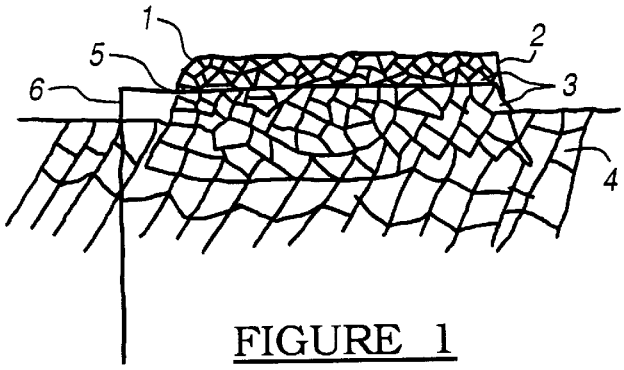
FIGS. 1 and 2 show a section and a sectional elevation respectively of an electrically conductive surface with grounding points.
Figure 2:
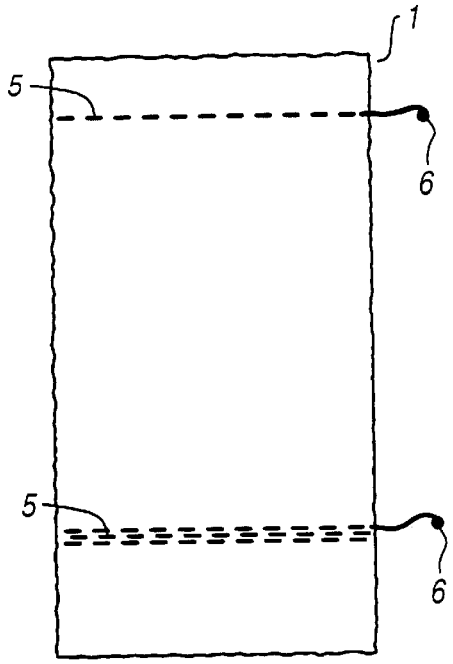

We now refer to FIGS. 1 and 2 which illustrate a section and a sectional elevation respectively of an electrically conductive surface 1 for roads, streets, open spaces, where the binding agent mixture 2 is electrically conductive. The electrically conductive binding agent mixture 2 surrounds an additive material 3 which may be sand, gravel or stones with specific grain sizes. The surface 1 is usually laid over coarse stones or a layer of crushed stones which will act as an insulator. In modern road building insulation is normally used and such plastic layers will be good electrical insulators. In order to ensure good electrical connection to earth it will therefore be necessary to have earth connections in the surface 1. In the surface 1, one or more uninsulated conductors 5 are inserted at specific intervals. The conductor 5 may also consist of a flexible uninsulated metal network of a certain width. Such conductors 5 are inserted across the longitudinal direction of the surface 1 at specific intervals and connected to earth at earthing point 6. An earthing rod can be used as an earthing point 6. In addition earth conductors may be inserted in the longitudinal direction of a surface 1 as illustrated in FIGS. 3 and 4.

At places where an electrically conductive surface 1 is laid over areas where the base has good electrical conductivity, with the result that it will act as an earth connection, earthing points 6 will be unnecessary and may be omitted.

Figure 3:
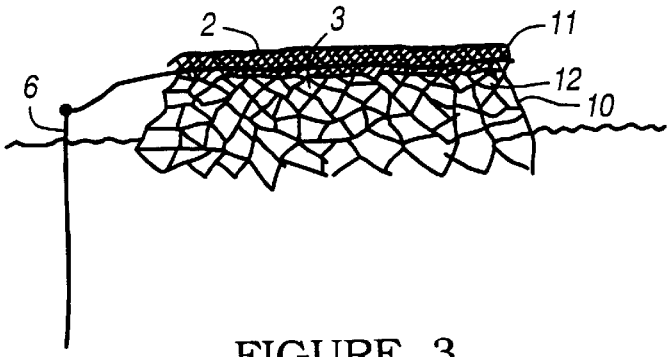
FIGS. 3 and 4 show a section and a sectional elevation respectively of an electrically conductive surface laid as a top layer on an existing road and with earthing points.
Figure 4:
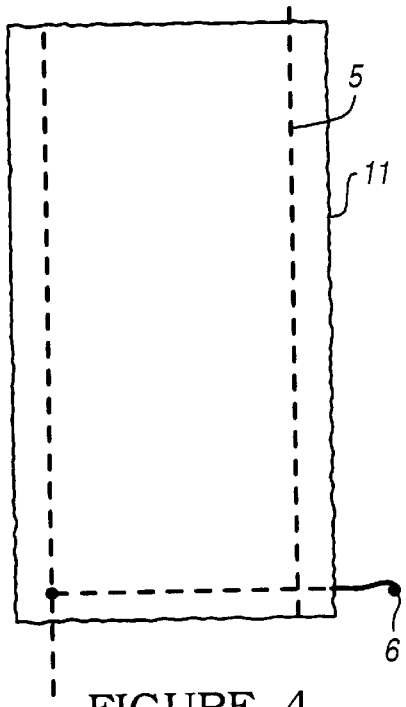

FIGS. 3 and 4 illustrate a section and a sectional elevation respectively of an existing road, street, open space 10. On an existing road 10 an electrically conductive surface 11 is laid as a top layer. The already existing surface 12 may be of a standard commercial type of bitumen, asphalt or oil gravel, or of concrete. By laying an electrically conductive surface 11 in the form of a top layer on already existing roads, streets, open spaces which at present have insulating surfaces 12, they will be converted into electrically conductive surfaces.

The electrical conductive surface 11 may consist of an electrically conductive binding agent mixture 2 and can be used with or without additive materials 3 such as sand or gravel with a certain grain size. The surface 11 can be laid directly on the existing roadway 10 as a thin top layer with a thickness from a few millimetres to several centimetres. The advantage is thereby obtained that the electrically conductive surface does not alter the existing roadway's 10 characteristic with regard to elasticity and mechanical properties. It is also possible to let this surface 11 cover only parts of the existing road, for example in the form of road marking. In this case in a preferred embodiment of the invention there will be employed known per se materials, with the possible addition of an electrically conductive material such as, for example a carbon powder or metal powder.

At one or more points in the electrically conductive surface 11 there are inserted one or more uninsulated electrical conductors 5. At specific intervals the conductor or conductors are connected to earth at earthing point 6. An earthing rod may be used as earthing point. Already existing earthing points may also be used. The distance between each earthing point 6 is dependent on whether conductors are employed on one or both sides of the surface, on the conductivity in the electrically conductive surface and on the traffic density on the road, street or open space, which will determine how great a volume of exhaust gas has to be conveyed to the surface and neutralised per time unit. The distance between each earth connection can be determined in the most expedient manner by measurements. In tests it has been found that distances from 1 to 1000 metres can be employed, but it will be most preferred to employ distances from 20 to 200 metres.

Figure 5:
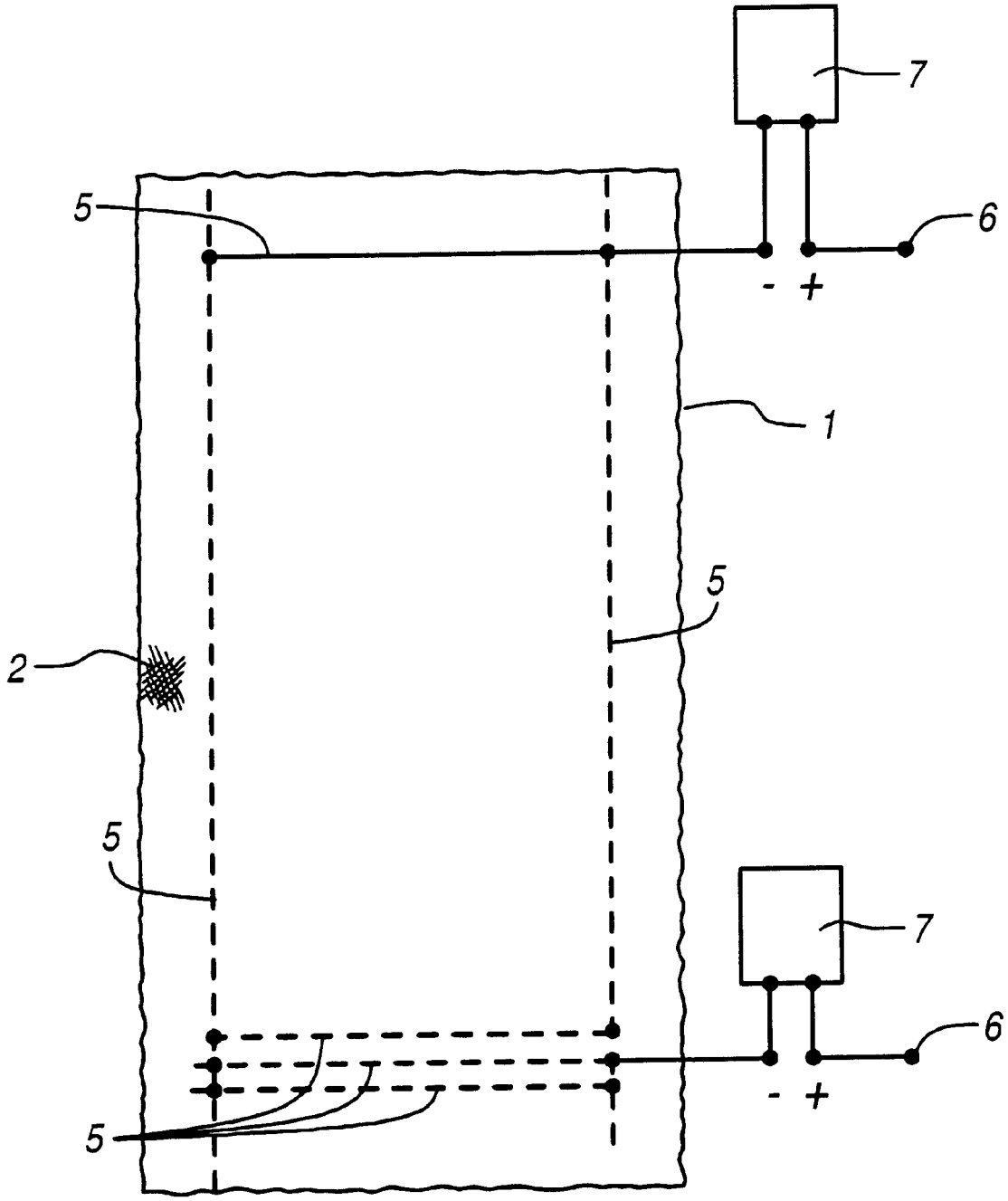
FIG. 5 is a sectional elevation of an electrically conductive surface where a voltage source is connected between the surface and the earthing point.

FIG. 5 is a sectional elevation of an electrically conductive surface 1 for roads, streets, open spaces etc., where the binding agent mixture 2 is electrically conductive. The electrically conductive surface 1 may be laid as a new road or as a top layer on an already existing road. One or more uninsulated conductors 5 are inserted in the surface 1. Such conductors can be inserted both along and across the longitudinal direction of the surface 1 and connected to earth at earthing point 6. An earthing rod can be employed as earth point. A direct voltage source 7 is connected to the earth conductor 5 between the surface 1 and the earthing point 6. The voltage source 7 is connected to the negative pole of the surface 1 and the positive pole to the earthing point 6. The surface 1 thereby obtains negative potential relative to earth. The voltage or the potential difference between the surface 1 and earth 6 is dependent on how great a volume of exhaust gas has to be conveyed to the surface and neutralised per time unit. The potential difference can be determined in the most expedient manner by means of measurements. In tests it has been found that potential differences between 1 V and 1000 V can be employed, but it is most preferred to employ potential differences between 1 V and 100 V.

In order to obtain an electrically charged surface for roads, streets, open spaces or the like, a binding agent mixture is used which consists primarily of bitumen to which electrically conductive materials such as carbon powder or metal powder are added. Asphalt, gas tar, bituminous polymers, plastic materials, etc. can be added to the bitumen. In the present invention the word bitumen is used for the main component even though the above-mentioned materials may be added to the bitumen.

In order to obtain an electrically conductive road surface for surfaces in the vicinity of roads, streets and open spaces, and marking on roads, streets and open spaces, known per se materials are employed to which an electrically conductive material such as carbon powder or metal powder is added.

It is important that the materials which are employed to make the bitumen electrically conductive should be easily mixed with bitumen and not detract from the bitumen's properties as a binding agent in a road surface. It has been found that carbon powder, which is a conductive material, has these properties. All types of carbon powder can be used, such as carbon black, or powder of graphite, coal, coke or charcoal. Carbon fibre may also be used since, in addition to providing electrical conductivity it will also give the bitumen mixture great mechanical strength.

In addition to carbon powder metal powder can be used either alone or together with carbon powder. Metal powder is particularly applicable where the metal grains are in the form of flakes or thin fibres. Aluminium pigments in the form of flakes are one example.

In a binding agent mixture the electrical conductivity will vary with the amount of carbon powder mixed in. The electrical resistance, which is the inverse value of the conductivity, is simpler to measure with commercial measuring instruments. Measurements have been carried out which show that the electrical resistance in a conductive surface should lie within those values which are measured for samples taken of different types of earth. Earth samples are measured from 2 Mohn/cm to 50 Mohm/cm. The resistance in earth samples is probably highly dependent on the moisture content in the sample and on the content of sales which are soluble in water and form ions.

Figure 6A:
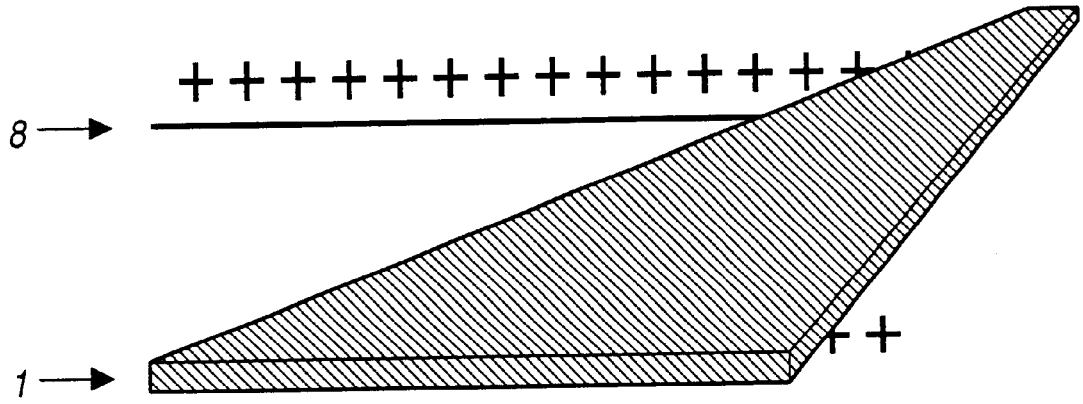
FIGURE 6A (PRIOR ART)
FIG. 6*a* illustrates the electrostatic image without the use of the present invention.
Figure 6B:
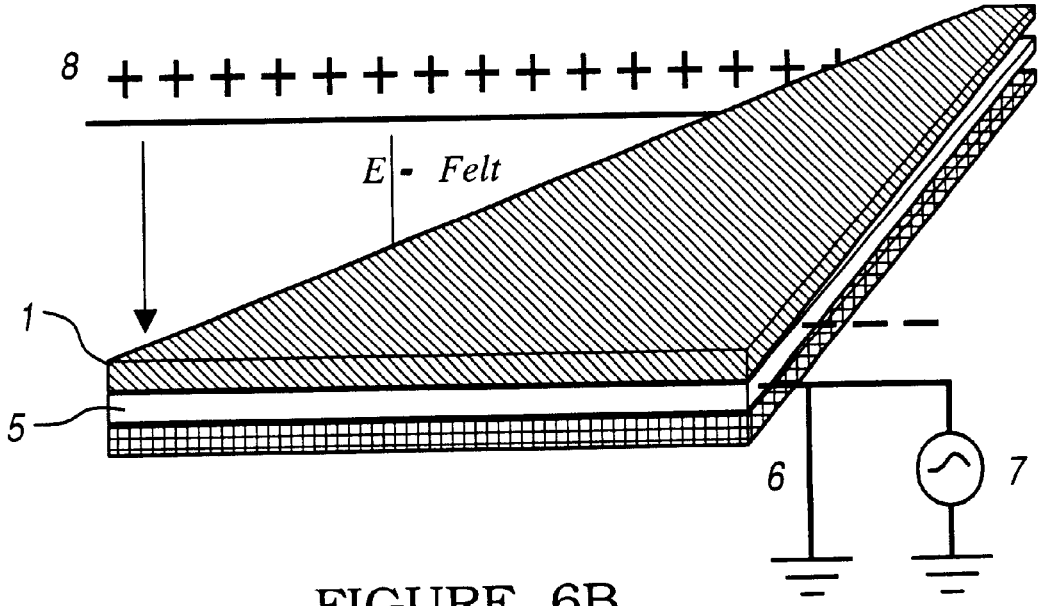
FIG. 6*b* illustrates the electrostatic image with the use of the present invention.

We now refer to FIG. 6, which illustrates an example of application of the invention on a road. FIG. 6*a* shows the electrostatic image without the use of the invention, where ionised gases and/or particles 8 and the road surface 1 are both positively charged, thereby repelling each other. FIG. 6*b* shows the electrostatic image with the use of the present invention. The surface 1 is connected via conductors 5 to earth 6 or to one pole of a voltage source 7 whose other pole is connected to earth. Thus the surface 1 will represent a cathode and the ionised gases and/or particles 8 will represent an anode. Together they will form a capacitor. In the field between the anode and the cathode an electrical field will be created and thereby an electrostatic force on the ionised gases and/or particles. The result of this is that the surface has an attractive effect, thus preventing air-borne dust.

Tests have been carried out which demonstrate that ionised exhaust gases and particles from internal combustion engines have a substantially longer suspension time over an insulating surface than over an electrically conductive surface connected to earth. In this context suspension time refers to the time required for a gas mixture to pass from the original gas composition until it is naturally converted in the ambient air or the time it takes for particles to fall to the ground.

Two closed glass boxes were filled with a specific volume of exhaust gas from an internal combustion engine with known gas and particle concentration. The volume was measured at 50 litres and the gas mixture was measured at: 18 vol $\%O_2$, 0.9 vol $\%CO_2$, 0.5 vol % CO and 350 ppm hydrocarbons and with $N_2$ as residue. One box was placed on an electrically conductive surface which was not supplied with a charge. One box was placed on an electrically conductive surface connected to earth. Measurements with an ion-meter showed that the gas over an insulated surface kept its original composition for a much longer time than the gas over an electrically conductive surface. The suspension time for ionised exhaust gases over the insulating surface was approximately double the length of the suspension time over an electrically conductive surface connected to earth. In this experiment no account was taken of the fact that an insulating surface will usually have a positive charge, which would have caused the suspension time for ionised gas and particles over such a surface to be considerably longer.

Measurements have been performed over different surfaces with different electrical conductivity. The conductivity has varied from a semi-conductive binding agent to a surface consisting of a conductive plate. The tests show that the suspension time of ionised gases and particles is reduced when the electrical conductivity in a surface increases.

What is claimed is:

1. A method for controlling the concentration of charged ionised gas and/or particles over roads, street, or open spaces, characterized in that an electrical field is established between the said ionised gas and/or particles and an open, essentially stationary surface (1; 11) over such roads, streets, or open spaces, and/or over open, essentially stationary surfaces in the vicinity of such roads, street or open spaces, by charging electrically or giving a negative electrical potential to at least the top layer of said surface (1; 11), and that this electrically charged top layer is connected to earth or to one pole of a voltage source (7) whose other pole is connected to earth, with the result that the said ionised gas and particles will be attracted to or repelled from the surface (1;11).

2. A method according to claim 1, characterized in that in at least the top layer of the surface (1) there is employed a binding agent mixture (2) which is electrically conductive and which surrounds an additive material (3) in the form of sand, gravel or stones.

3. A method according to claim 2, characterized in that said binding agent mixture (2) is a commercially available binding agent which may consist of bitumen, asphalt, gas tar, bituminous polymers, plastic materials, etc. and to which an electrically conductive material is added.

4. A method according to claim 3, characterized in that said electrically conductive material contains carbon powder and/or metal powder.

5. A method according to claim 4, characterized in that said connection to earth or to one pole of said voltage source (7) is achieved by inserting uninsulated electrical conductors (5) in said top layer and that this is connected at one or more points to earth or to the said one pole of the said voltage source (7).

6. A method according to claim 4, characterized in that said top layer is composed of a coating (11) which is laid on top of the entire or parts of said insulating surface (12), in the form of road marking.

7. A method according to claim 3, characterized in that said connection to earth or to one pole of said voltage source (7) is achieved by inserting uninsulated electrical conductors (5) in said top layer and that this is connected at one or more points to earth or to the said one pole of the said voltage source (7).

8. A method according to claim 3, characterized in that said top layer is composed of a coating (11) which is laid on top of the entire or parts of said insulating surface (12), in the form of road marking.

9. A method according to claim 2, characterized in that said connection to earth or to one pole of said voltage source (7) is achieved by inserting uninsulated electrical conductors (5) in said top layer and that this is connected at one or more points to earth or to the said one pole of the said voltage source (7).

10. A method according to claim 2, characterized in that said top layer is composed of a coating (11) which is laid on top of the entire or parts of an insulating surface (12), in the form of road marking.

11. A method according to claim 1, characterized in that said connection to earth or to one pole of a voltage source (7) is achieved by inserting uninsulated electrical conductors (5) in said top layer and that this is connected at one or more points to earth or to the said one pole of the said voltage source (7).

12. A method according to claim 11, characterized in that said top layer is composed of a coating (11) which is laid on top of the entire or parts of an insulating surface (12), in the form of road marking.

13. A method according to claim 1, characterized in that said top layer is composed of a coating (11) which is laid on top of the entire or parts of an insulating surface (12), in the form of road marking.

14. A method according to claim 13, characterized in that said coating (11) comprises an electrically conductive material.

15. A method according to claim 1, characterized in that said surfaces in the vicinity of a road, street, or open space are composed of the walls in a tunnel, safety barrier, or noise baffle.

16. A method according to claim 15, characterized in that said surfaces are coated with an electrically conductive material.

17. A method for controlling the concentration of charged ionised gas and/or particles over roads, street, or open spaces, characterized in that an electrical field is established between the said ionised gas and/or particles and an open, essentially stationary surfaces (1; 11) over such roads, streets, or open spaces, and/or over open, essentially stationary surfaces in the vicinity of such roads, street or open spaces, by charging electrically or giving a negative electrical potential to at least the top layer of said surface (1; 11), and that this electrically charged top layer is connected to earth, with the result that the said ionised gas and particles will be attracted to or repelled from the surface (1;11).

* * * * *